United States Patent [19]

Manko

[11] Patent Number: 4,989,868

[45] Date of Patent: Feb. 5, 1991

[54] GOLF TEE TOOL

[76] Inventor: Edward E. Manko, 499 St. Vincent Dr., Akron, Ohio 44313

[21] Appl. No.: 187,352

[22] Filed: Apr. 28, 1988

[51] Int. Cl.[5] ..... A63B 57/00

[52] U.S. Cl. ..... 273/32.5

[58] Field of Search ..... 273/33, 202–212, 273/32.5, 183 A, 183 R; 272/32.5

[56] References Cited

U.S. PATENT DOCUMENTS

| | | | |
|---|---|---|---|
| 682,681 | 9/1901 | Haas | 273/32.5 |
| 1,936,625 | 11/1933 | Goldman | 273/203 |
| 3,206,197 | 9/1965 | Miotke | 273/32.5 |
| 3,540,720 | 11/1970 | Hoe, Jr. | 273/32.5 |
| 3,609,198 | 9/1972 | Armstrong | 273/32.5 |
| 3,671,036 | 6/1972 | Rubino | 273/32.5 |
| 3,671,037 | 6/1972 | Murdock, Jr. | 273/32.5 |
| 4,313,604 | 2/1982 | Baxter | 273/32.5 |

FOREIGN PATENT DOCUMENTS

| | | | |
|---|---|---|---|
| 586581 | 11/1959 | Canada | 273/32.5 |

*Primary Examiner*—Theatrice Brown

*Attorney, Agent, or Firm*—Renner, Kenner, Greive, Bobak, Taylor & Weber

[57] ABSTRACT

A tool for placing a gold tee into the ground such as to maintain a golf ball at a predetermined height above the ground. A pair of disks are interconnected by a cylindrical body, an upper portion of which is of a hollow nature. A slot passes through a solid bottom portion of the body and the bottom disk. The upper hollow portion is semicircular in cross section and, in combination with the slot, adapts the tool for receiving a golf tee therein. With the tee so received, it can be placed into the ground such that the tee extends above the ground a distance fixed by the separation between the two disks.

3 Claims, 1 Drawing Sheet

GOLF TEE TOOL

TECHNICAL FIELD

The invention herein resides in the art of sporting equipment and, more particularly, to equipment for use in the game of golf. Specifically, the invention relates to a tool for assisting in the setting of a golf tee such that each time the tee is set, it maintains the ball at the same distance above the ground surface.

BACKGROUND ART

The game of golf is a popular one, not only in the United States, but throughout the world. Golfers readily accept the fact that no two "lies" along the fairway or on a putting green are the same. It is also well established that, when playing according to the sanctioned rules of golf, one may not improve his "lie," but must play the ball as he finds it. However, every hole allows the golfer to establish his "lie" on at least the tee shot. In that shot, the golfer may position the ball upon a tee anywhere within a given area. Most preferably, golfers find that a specific tee height is desirable for a specific club. For example, a golfer may find that, when using his driver, he prefers that the golf be teed to a height of 1⅜", but when using his 3 wood, may desire only 1". Similarly, if an iron is to be used as the club off of the tee, the golfer may desire still a different height for the ball.

Typically, golfers often hold the wooden or plastic tee between the index and middle finger, allowing the cup to protrude toward the palm. A ball is then maintained in the palm of the golfers hand and upon the cup. The golfer then urges the pointed end of the tee into the ground, with the ball seated in the cup, until the two fingers securing the tee sense that it has been placed to the appropriate depth. As one might imagine, such is a most inaccurate means of placing the golf ball height, particularly in a "game of inches" such as golf.

Accordingly, it is most desirable that there be provided a device which allows for routine accurate placement of the golf ball on each tee shot. U.S. Pat. Nos. 3,408,079; 3,203,700; and 3,114,557 all teach the placement of a disk of some type about the shaft of the tee for the purpose of limiting the depth of penetration of the tee. In somewhat similar manner, U.S. Pat. Nos. 4,516,780; 3,467,390; 3,690,676; and 2,693,358 all teach a mechanism for teeing a golf ball at adjustable heights. In accordance with the concept of the invention, it is also presented that U.S. Pat. No. 3,606,344 is of general interest.

The structures of the prior art all teach a specifically designed golf tee, or a tee which has been significantly altered. None of the prior art references teach or suggest a tool which may be used in conjunction with a standard golf tee, adapted to receive such a tee, and to assist in placing it at a specific height.

DISCLOSURE OF INVENTION

In light of the foregoing, it is a first aspect of the invention to provide a tool which will facilitate the placement of an ordinary golf tee at specified heights.

Another aspect of the invention is the provision of a tool which is capable of setting an ordinary golf tee at more than one height.

Yet an additional aspect of the invention is the provision of a tool which eases the placement of a golf tee into the ground.

Yet another aspect of the invention is the provision of a tool for placing golf tees which is inexpensive to fabricate, while being durable and reliable in use.

The foregoing and other aspects of the invention which will become apparent as the detailed description proceeds are achieved by a tool for placing a golf tee into the ground such as to maintain a golf ball at a predetermined height above the ground, comprising: top and bottom plate members spaced apart from each other; a cylindrical body interconnecting said top and bottom plate members; and an opening in said bottom plate member for receiving a stem of a golf tee therethrough.

Other aspects of the invention are attained by a tool for assisting in the placing of a golf tee into the ground, comprising: a top disk; a bottom disk parallel to said top disk; and a cylindrical body member interposed between said top and bottom disks.

DESCRIPTION OF DRAWING

For a complete understanding of the objects, techniques and structure of the invention, reference should be had to the following detailed description and accompanying drawing wherein:

FIG. 1, comprising FIG. 2, comprising

BEST MODE FOR CARRYING OUT THE INVENTION

Figures 2A, 2B:
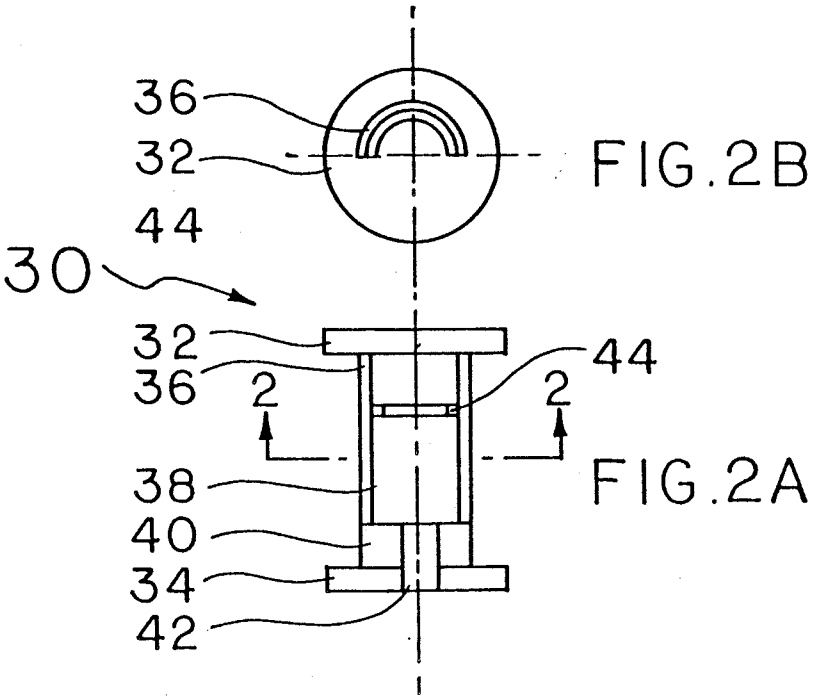
FIGS. 2A and 2B, are respectively front and top plan views of a second embodiment of the invention.

Referring now to the drawing and more particularly FIG. 1, it can be seen that a first embodiment of a tool for setting golf tees is designated generally by the numeral 10. The tool consists of a top plate 12 which is parallel to and separated from a bottom plate 14. In a preferred embodiment of the invention, the plates 12,14 are disk-shaped, although it will be understood that various geometric configurations could be employed within the confines of the invention.

Figures 1A, 1B, 1C:
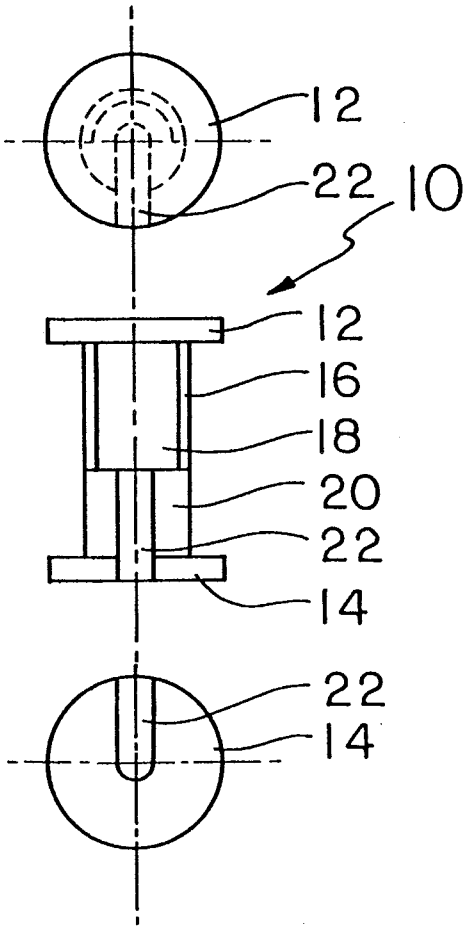
FIGS. 1A–1C, are respectively front plan, bottom plan, and top plan views of a golf tee tool according to a first embodiment of the invention.

Interconnecting the top and bottom plates 12,14 is a cylindrical or tubular body member 16. An upper portion 18 of the body 16 is open or hollow, with the cylindrical body 16 having a wall thickness at such point on the order of 1/32–⅛", and most preferably, 1/16". In cross section, the open portion 18 of the body 16 is semicircular in cross section. A lower portion of the body 16 is closed, as designated by the numeral 20. The portion 20 may either be of solid material or simply comprise an extension of the cylindrical wall. As shown in FIG. 1C, it will be appreciated that the portion 20 in the embodiment disclosed is of a solid nature.

A slot 22 extends through the solid or closed portion 20 and the bottom plate 14 to a circle having its center at the center point of the disk-shaped bottom plate 14. As shown, the diameter of such circle is equal to the width of the slot 22.

The spacing between the bottom surfaces of the plates 12,14 establishes the height of the tee above the ground. In preferred embodiments, this distance may be, for example, ¾", 1", or ⅜". The width of the slot 22 is preferably on the order of ⅛–¼", and most preferably 13/64", such being an appropriate width to accommodate the stem of a standard golf tee. The opening 18 has a diameter of $\frac{3}{8}$–$\frac{5}{8}$" and, most preferably, $\frac{1}{2}$" to accommodate the head of a standard golf tee.

In use, a golf tee is placed into the tool 10 with the stem being received by the slot 22 and extending through the bottom plate 14, and the head or cup of the tee being in contacting engagement with the bottom surface of the top plate 12. With the tee so positioned, the golfer simply pushes the tool 10 onto the ground surface until the bottom portion of the bottom plate 14 rests upon the ground. At this time, the portion of the tee stem protruding through the slot 22 beneath the bottom plate 14 has entered the ground. The tool 10 is then removed from the tee by horizontally sliding the tool 10 therefrom. The tee is then left in the ground at a fixed height above the ground determined by the distance between the bottom surfaces of the plates 12,14. Accordingly, each time the tool 10 is used for placing a tee, the tee is a specific predetermined height.

It will be appreciated that a tool according to the invention may be configured such as to set tees at various heights. Such a tool is designated generally by the numeral 30 in FIG. 2. As shown, there is again a top plate 32 and a bottom plate 34, each of disk-shaped nature and parallel to the other. A cylindrical body member 36 interconnects the plates 32,34 in the manner discussed earlier with respect to FIG. 1. An open top portion 38 and a closed or solid portion 40 is also provided as in the prior embodiment. A slot 42 extends to and encompasses the center of both the solid portion 40 and the bottom disk 34.

In the embodiment of FIG. 2, a flange or lip 44 is maintained about an inner peripheral surface of the cylindrical body member 36, both the body member 36 and lip 44 being semicircular in configuration. Preferably, the walls of the body portion 36 and the width of the flange 44 are 1/16". Accordingly, with the inner diameter of the cylindrical portion 36 being on the order of $\frac{1}{2}$", the inner diameter of the lip 44 is on the order of $\frac{3}{8}$". This diameter is sufficient to accommodate the stem or throat of a golf tee if the same is to be placed with the cup in engagement with the bottom surface of the top plate 32.

It is also contemplated that the flange or lip 44 may continue its circular path beyond the confines of the body member 36, forming an arc on the order of 270°–300°. This extended lip provides a larger under surface for engaging the top periphery of the cup of the golf tee.

It will be appreciated that a golf tee may be placed into the tool 30 in the manner discussed with respect to the embodiment of FIG. 1 with the cup of the tee resting against the bottom surface of the top plate 32. The tool is used in the manner discussed earlier to set the tee at a height determined by the distance between the bottom of the top plate 32 and the bottom of the bottom plate 34. This same tool may be used to set the tee at a lower height by placing the tee with the cup in engagement with the bottom surface of the lip 44. The use of the tool is identical as that discussed above, but the resultant height of the tee is, of course, lower.

It will be appreciated that any number of lips 34 may be positioned within the hollow portion 36 of the tool 30. Accordingly, a single tool may be used for setting a tee at any of various heights. It is only necessary that the width of the lips 44 be sufficient to engage a peripheral top surface of the cup of the tee, while having an opening therein sufficient for accommodating the throat or stem of the tee when the tee is to engage an upper lip or the top plate 32.

It will be appreciated to those skilled in the art that the device of the instant invention may be readily molded of plastic or other suitable material. It will also be appreciated that various configurations of the specifics of the invention may be employed.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Accordingly, for an appreciation for the true scope and breath of the invention, reference should be had to the following claims.

What is claimed is:

1. A tool for placing a golf tee into the ground such as to maintain a golf ball at a predetermined height above the ground, comprising:

an elongated hollow cylindrical body member having spaced apart top and bottom plate members;

an elongated body member having said inner wall surface and an outer wall surface and interconnecting said top and bottom plate members;

a lip extending inwardly from said inner wall surface and being intermediate said top and bottom plate members; and an opening in said bottom plate member for receiving a stem of a golf tee therethrough, said opening comprising a slot passing from a side edge of said bottom plate member to the center of said bottom plate member, said top plate and lip being adapted to mutually exclusively engage a cup of said tee.

2. The tool as recited in claim 1 wherein said top portion of said elongated body member is open along a side thereof for receiving the head of a standard golf tee and being in alignment and communication with said slot passing through said bottom plate and said bottom portion of said elongated body member.

3. The tool as recited in claim 2 wherein said top and bottom plate members are disks.

* * * * *